United States Patent [19]

Haroutel et al.

[11] Patent Number: 4,787,533

[45] Date of Patent: Nov. 29, 1988

[54] DISPENSER FOR FLAT PRODUCTS

[75] Inventors: Jean-Claude Haroutel, Orsay; Philippe Michel, Asnieres, both of France

[73] Assignee: SML Alcatel, Paris, France

[21] Appl. No.: 133,459

[22] Filed: Dec. 15, 1987

[30] Foreign Application Priority Data

Dec. 17, 1986 [FR] France ..... 86 17687

[51] Int. Cl.[4] ..... G07F 11/04

[52] U.S. Cl. ..... 221/12; 221/123; 221/129; 221/133; 221/211; 414/280; 271/9; 271/107

[58] Field of Search ..... 221/6, 12, 123, 133, 221/129, 191, 211, 247; 414/279–281, 283, 661; 271/9, 107; 194/906

[56] References Cited

U.S. PATENT DOCUMENTS 3,361,295 1/1968 Marchant ..... 221/123 X
3,655,092 4/1972 Hall et al. ..... 221/133

FOREIGN PATENT DOCUMENTS 0193797 9/1986 European Pat. Off. .
1599027 6/1971 Fed. Rep. of Germany .
2089943 1/1972 France .
2563985 11/1985 France .

*Primary Examiner*—Charles A. Marmor
*Attorney, Agent, or Firm*—Sughrue, Mion, Zinn, Macpeak, and Seas

[57] ABSTRACT

A dispenser for flat products consists of a cabinet containing magazines for storing a plurality of products stacked according to predefined categories, with an outlet slot for a product selected from one of the magazines. A mechanism for extracting and dispensing the products in front of the magazines extracts the top product from a selected stack and transfers it to the outlet slot. This mechanism comprises a product holding device, individually controlled and motorized vertical and horizontal carriages carrying this device and a support for the device articulated to one of the carriages. The support assumes a holding position in which the device is placed against the top product in a selected stack and then moves to a position retracted against the carriages, holding the product. The magazines are inclined to the horizontal so that the stacks are offered up slantwise to the mechanism and the outlet slot is in a side of the cabinet, between the magazines and the mechanism. The dispenser is controlled by a control circuit responsive to a signal selecting one of the products.

21 Claims, 12 Drawing Sheets

DISPENSER FOR FLAT PRODUCTS

BACKGROUND OF THE INVENTION

1. Field of the Invention

The present invention relates to dispensers for flat products. It is applicable in particular to the dispensing of postal packets of different types such as packing cartons of different formats supplied folded flat and padded envelopes of different formats. It is equally applicable to the dispensing of other types of flat products, such as gramophone records, for example, or magazines and/or newspapers and/or books supplied individually under a supporting tape or film.

2. Description of the Prior Art

Dispensers of this kind are designed to be installed in places where they can be used by the public. They deliver automatically one or more products selected from those stored within them against payment for the selected products.

A dispenser of this type is known from French patent application No. 85 02673. This dispenser is in the form of a cabinet closed at the front by a door. A product receiving basket is mounted in the door to deliver the selected product to the user.

Inside the cabinet, on horizontal shelves, are a plurality of storage magazines for the products, stacked by category. The magazines are arranged to form at least one column; in said at least one column there is a gap between them to provide access for a product holding device disposed at the top of the stack. This device forms part of a product extraction and dispensing mechanism mounted in the cabinet and essentially comprising a vertical carriage and a horizontal carriage. The vertical carriage extends horizontally across the set of magazines. The horizontal carriage is mounted on a guide carried by the vertical carriage and and is movable transversely between the magazines and the door of the dispenser, tipping towards the door at the end of its travel. The holding device is mounted on the horizontal carriage and, by appropriate displacement of the carriages, is brought above a required one of the stacks and then picks the product from the top of that stack, after which it is moved over the product receiving basket and then releases the product it has picked up.

The extraction and dispensing mechanism of this known dispenser can further comprise a third or longitudinal carriage mounted to move longitudinally on the vertical carriage and coupling the horizontal carriage to the vertical carriage. This longitudinal carriage makes it possible to move the holding device across different columns of product storage magazines or across double magazines belonging to the same column.

This product extraction and dispensing mechanism is complex, costly and bulky and necessitates means for controlling the position of the holding device and for controlling the carriages which are difficult to implement in a satisfactory way, in particular because of vibration produced by the various parts of the product extraction and dispensing mechanism.

An object of the present invention is to provide a product dispenser of simpler design avoiding the aforementioned disadvantages and offering more reliable operation.

SUMMARY OF THE INVENTION

The present invention consists in a dispenser for flat products, comprising a cabinet and in said cabinet magazines for storing a plurality of products stacked according to predefined categories, an outlet for a product selected from one of the magazines, and a mechanism for extracting and dispensing the products disposed in front of the magazines and adapted to extract the top product from a selected stack and transfer it to said outlet, wherein the mechanism comprises a product holding device, individually controlled and motorized vertical and horizontal carriages carrying the device and a support for the device articulated to one of the carriages and adatped to assume a holding position in which the device is placed against the top product in a selected stack and a position retracted against the carriages, the dispenser further comprising a control circuit responsive to a signal selecting one of the products, and wherein the magazines are inclined to the horizontal so that the stacks are offered up slantwise to the mechanism and the outlet is in a side of the cabinet, between the magazines and the mechansim.

In accordance with another characteristic feature of the invention, the horizontal carriage may comprise a vertical beam extending over substantially the full height of the cabinet and mobile substantially widthwise and the vertical carriage is carried by the beam, is mobile substantially lengthwise of the beam and carries the support with the holding device.

The characteristics and advantages of the present invention will emerge from the following description of the embodiment shown in the appended drawings.

BRIEF DESCRIPTION OF THE DRAWINGS

FIG. 1 is a view of the holding device in cross-section.

FIG. 17A is a partial view in the direction of the arrow F in FIG. 17A.

DESCRIPTION OF THE PREFERRED EMBODMENT

The dispenser for flat products in accordance with the invention is described hereinafter in the context of automatic dispensing of postal packets.

This application is described by way of example only and is not limiting on the invention.

Figure 1:
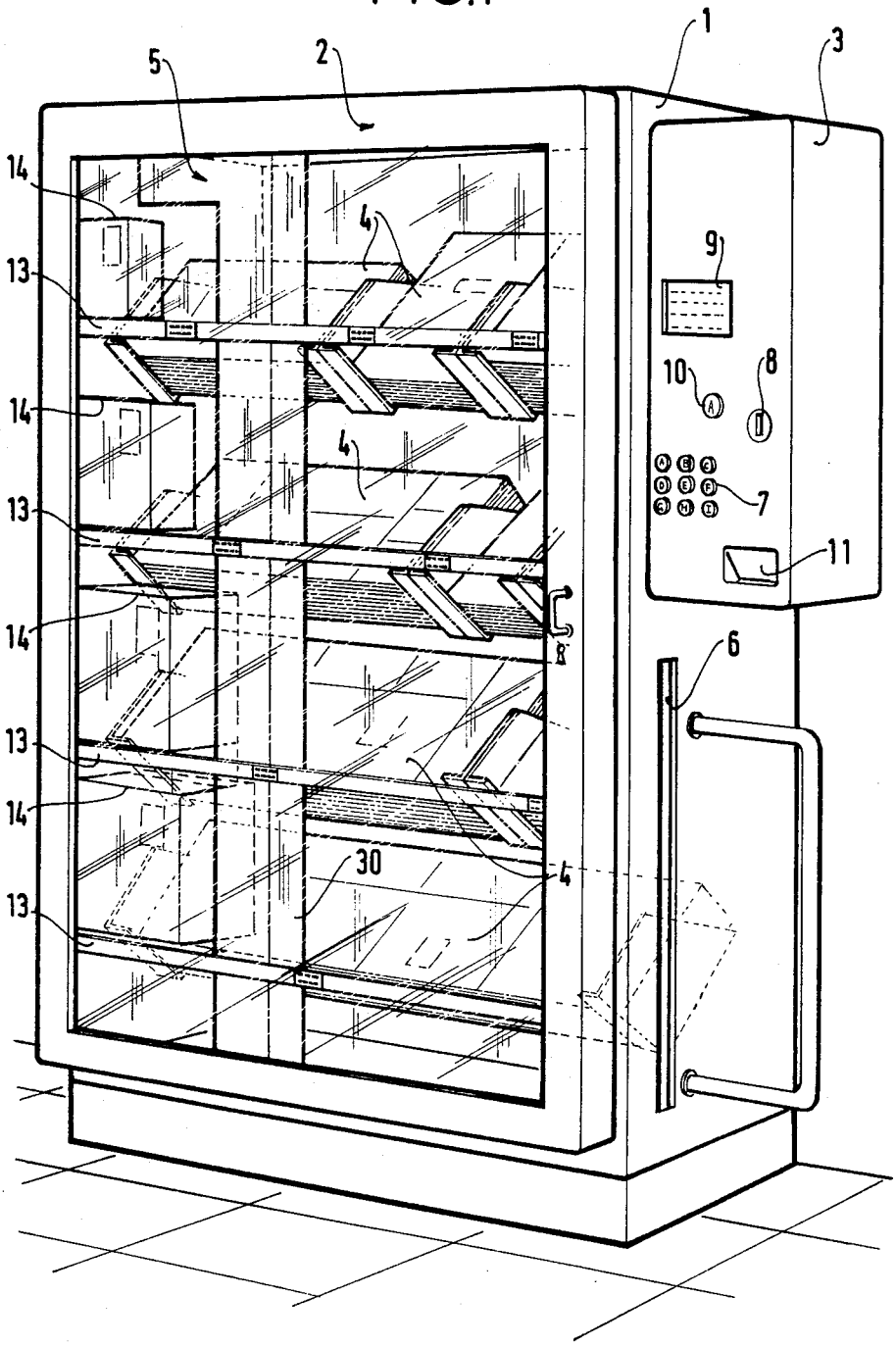
FIG. 1 is a perspective view of a postal packet dispenser in accordance with the invention.
Figure 2:
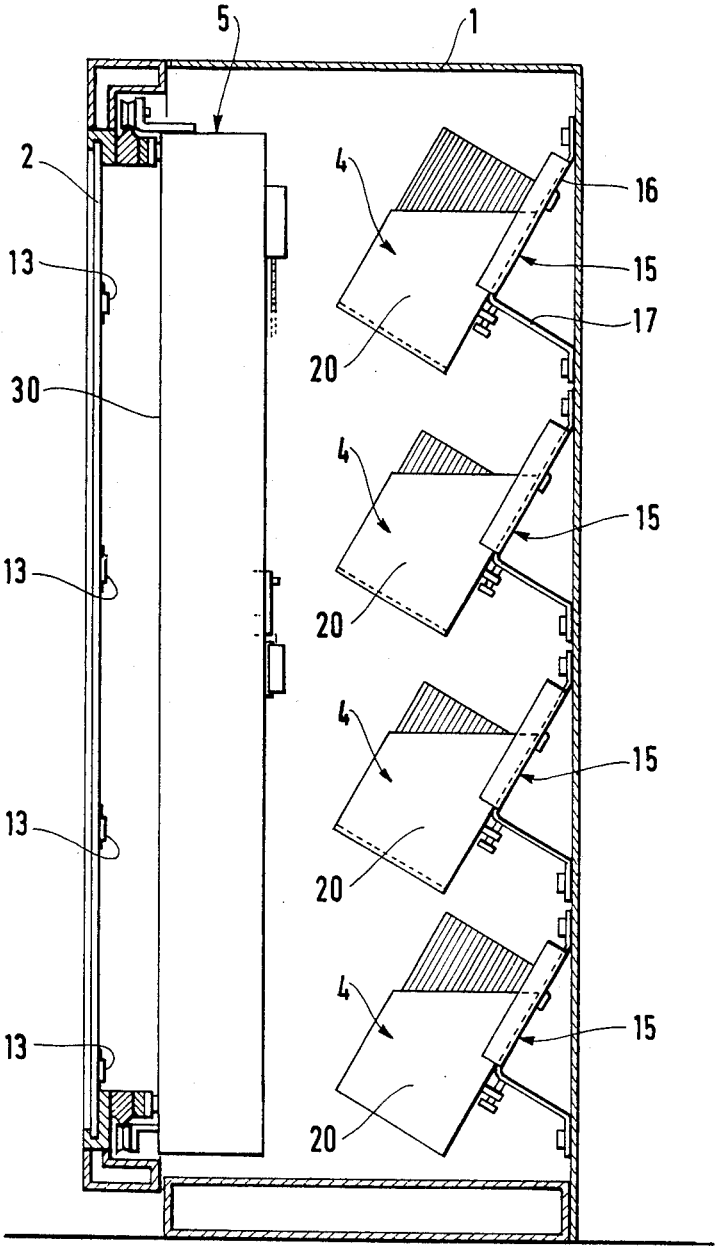
FIG. 2 is a schematic view of this dispenser in cross-section.
Figure 3:
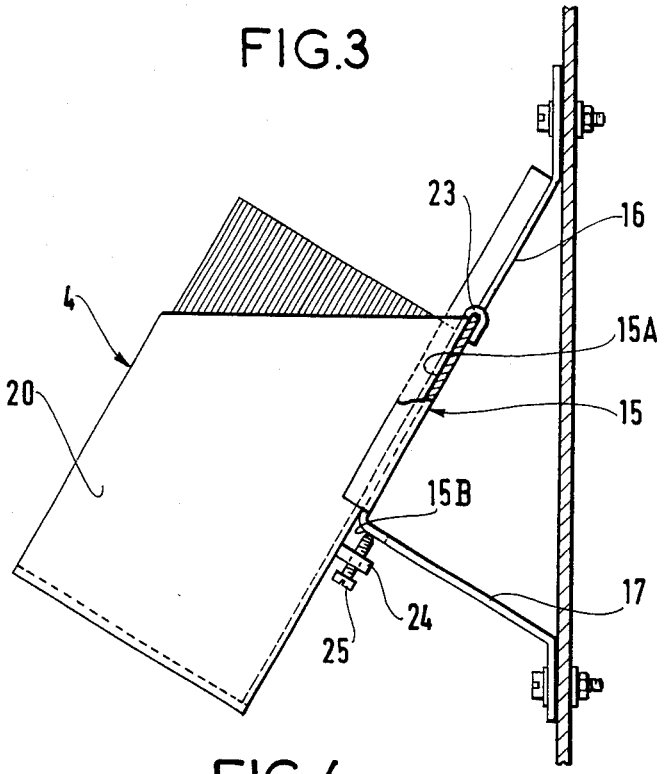
FIG. 3 is a view of one of the packet storage magazines in the dispenser, shown to a larger scale.
Figure 4:
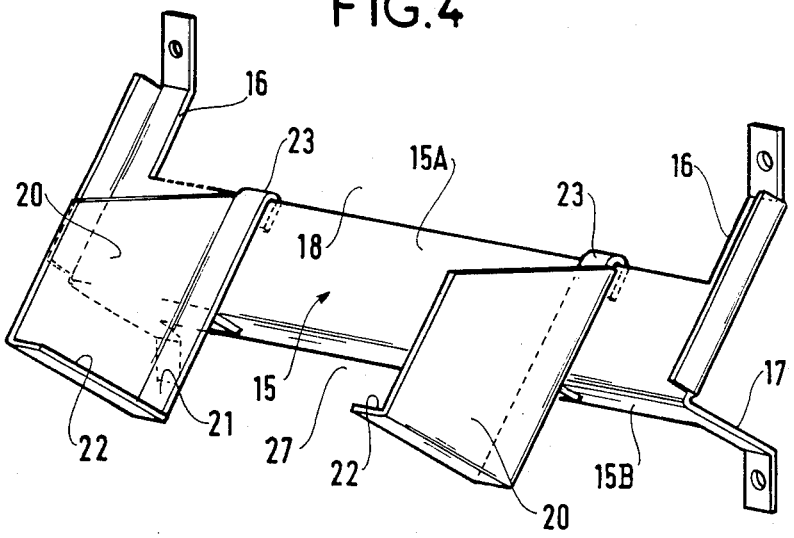
FIG. 4 is a perspective view of the storage magazine from FIG. 3 shown empty.

Referring to FIG. 1 and/or FIG. 2, the dispenser comprises a cabinet 1 resting on the ground and having its front surface closed by a glazed door 2 projecting from the body of the cabinet and a box unit 3 external to the cabinet and fixed to one of its sides at a height of approximately 1.20 m above the ground.

The cabinet 1 contains a plurality of magazines 4 storing different postal packets and a mechanism 5 for extracting and dispensing a selected one of the packets. This mechanism 5 is mounted in front of the magazines. The packets are cartons of different formats folded flat and padded envelopes of different formats. They are stacked according to their category and format.

The side of the cabinet comprises between the storage magazines and the mechanism 5 and under the box unit 3 a vertical outlet slot 6 for the selected packet.

The box unit 3 contains the control circuit for the extraction and dispensing mechanism. It carries on its front surface the controls necessary for using the dispenser, namely a keypad 7 for selecting a packet, an inlet device 8 to receive payment for the selected packet and a display module screen 9. There is also a key 10 for cancelling the request for the selected packet. These controls 7 through 10 are connected to the internal control circuit described with reference to FIG. 18.

The payment inlet device 8 on the cabinet 3 is shown as a coin slot. A cup 11 serves to return inserted coins, in particular where the request is cancelled.

Payment may be other by means of coins, of course. It may be by means of a payment card, for example, the payment inlet device depending on the mode of payment adopted.

On the inside of the door 2 and substantially in contact with the glass are label carriers 13 opposite the various storage magazines 4. They carry references for the various packets, for example reference numbers used to select them via the keypad, and the prices of the corresponding packets. Elongate light sources mounted under these supports 13 (not shown) illuminate the various packets.

On the hinged side of the door, the lefthand side in FIG. 1, samples 14 of the packets are displayed in the folded out configuration, on the corresponding level of magazines. These samples give users a clear idea of the shape and size of the corresponding packets which are folded flat in the magazines 4.

The internal organization of the cabinet with regard to the storage magazine 4 is clear from FIGS. 1 or 2 and 3 and 4.

The magazines 4 extend the full height of the cabinet on shelves 15 inclined to the horizontal, downwardly in the direction from the front to the back of the cabinet. Each shelf 15 is formed by a plate folded to a V-shape the two branches of which are designated 15A, 15B.

The branch 15A constitutes the shelf proper and is inclined at substantially 60° to the horizontal. At each end of its longitudinal edge towards the back of the cabinet the branch 15A has a lug 16 with a bent end portion and the branch 15B has similar lugs 17 with bent end portions, for fixing the shelf to the back of the cabinet. The lugs 16 define between them a cut-out 18 in the branch 15A leaving a small gap between the back of the cabinet and the shelf.

The branch 15B is at an angle of substantially 90° to the branch 15A. Alternatively, it could be at an angle of 60° to the branch 15A and extend horizontally under the latter in the cabinet.

Vertical partitions 20 are removably fitted to each of the shelves 15 to define the various magazines matched to the dimensions of the various packets. The partitions 20 rest on the branch 15A and project beyond the front edge of the shelf.

Each partition has its bottom edge 21 and its front edge 22 folded towards the inside of the magazine; the front edge 22 forms a retaining stop for the packets stacked on the shelf and on the bottom edges 21 of the two partitions of the magazine. The bottom edge 21 of each partition is folded over at the rear of the partition to form a lug 23 hooked over the longitudinal edge of the cut-out 18 in the rear of the shelf. A lug 24 stamped out from the upstanding bottom edge 21 of the partition projects downwardly from the partition at a position just in front of the shelf. It is used to lock the appropriately positioned partition to the shelf by means of a screw 25 inserted through the locking lug 24 and secured in the branch 15B of the shelf.

The two lateral partitions of each magazine project from the shelf that carries them. The resulting magazine is open at the top to expose completely the top packet on the inclined stack, is also open at the front and has in its bottom a cut-out 27 in front of the shelf. This cut-out 27 opening into the front of the magazine is used to sense when the magazine is empty, as will be explained hereinafter.

FIGS. 1 and 2 show that the extraction and dispensing mechanism 5 is in front of the storage magazines; it is carried by the door 2. It comprises a vertical beam 30 which is the only component visible through the closed glazed door when the dispenser is not operating.

Figure 5:
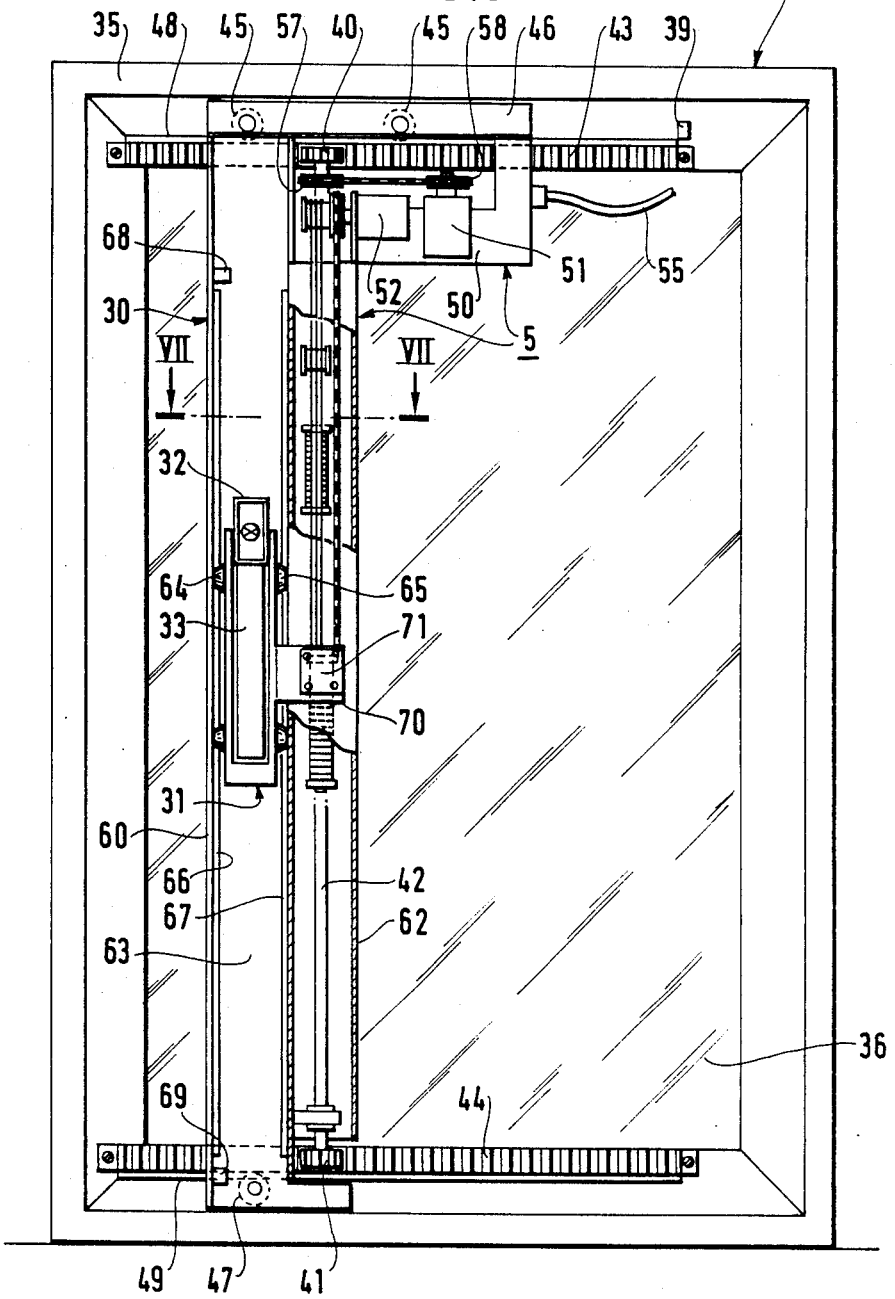
FIG. 5 is a schematic view of the inside surface of the door of the dispenser in FIG. 1, with its packet extraction and dispensing mechanism.

FIG. 5 gives a general view of the extraction and dispensing mechanism 5 mounted on the inside surface of the door, other components carried by the door having been omitted for reasons of clarity. The extraction and dispensing mechanism 5 comprises, in addition to the vertical beam 30, a vertical carriage 31 mounted on the beam and a holding device 32 mounted on a support 33 articulated to the carriage 31.

This extraction and dispensing mechanism 5, mounted on the door, gives complete access to all of the cabinet when the door is open, for assembling the storage magazines and loading them. It is itself easily accessible on the inside surface of the door when open, for assembling it and for any subsequent attention it may require.

The beam 30 is carried by the frame 35 of the door 2 and extends over substantially all its height. It is mounted on the door 2 as a horizontally mobile carriage moving between a limiting position defined by the samples 14 on the door (FIG. 1) and set by end stops 39 for the beam and the opposite edge of the door.

Figure 6:
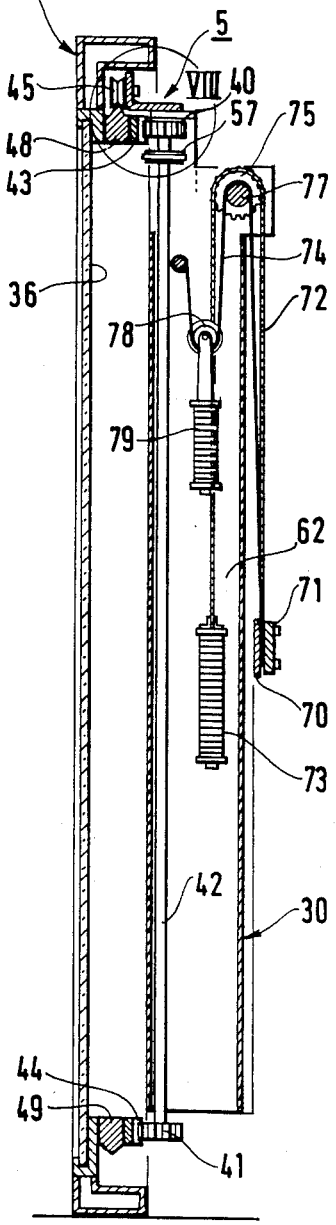
FIG. 6 is a schematic view in vertical cross-section of the dispenser door from FIG. 5.
Figure 8:
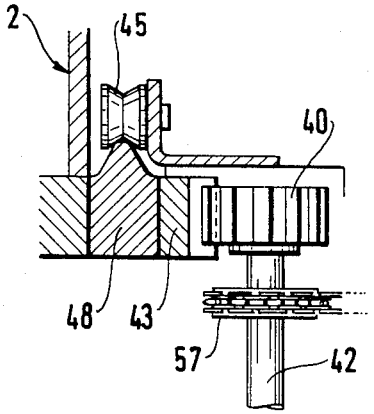
FIG. 8 is a view to a larger scale of the detail marked VIII in FIG. 6.

FIGS. 5, 6 and 8 show that two gearwheels 40 and 41 at the top and bottom of the beam coupled together by a shaft 42 drive the beam 30 along a top rack 43 and a bottom rack 44 fixed to the frame 35 of the door. Two rollers 45 mounted on a horizontal support 46 fixed to the upper end of the beam and a roller 47 mounted at the lower end of the beam guide it on a top rail 48 and a bottom rail 49 fixed to the frame 35 of the door, along the corresponding racks 43 and 44. An L-shaped support 50 is fixed between the support 46 and the upper part of the beam. It carries a motor 51 driving the horizontal carriage beam and a motor 52 driving the vertical carriage 31 on the beam.

Power is supplied to the motors by one or more cables (not shown) in trunking 55; the cables are attached to the cabinet leaving sufficient slack for the door to open and the beam to move. Two gearwheels 57 and 58 couple the beam drive motor 51 to the drive shaft 42 for the gearwheels 41 and 42.

Figure 7:
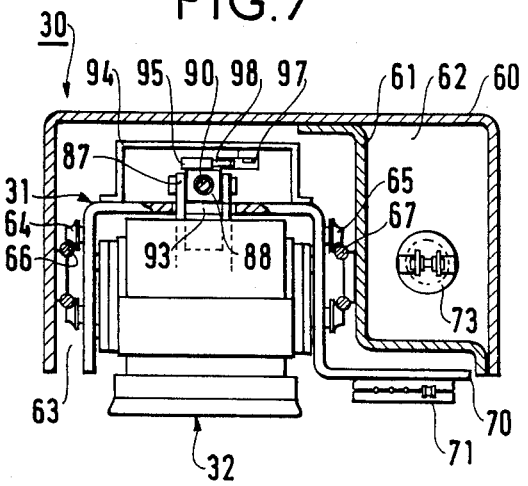
FIG. 7 is a schematic view in horizontal cross-section and to a larger scale of the mechanism carried by the door shown in FIG. 5.

FIGS. 5 and 7 show that the beam 30 is formed by assembling a U-shaped member 60 and an L-shaped member 61 inside the latter; the L-shaped member 61 has upstanding edges for fixing it to the inside of the U-shaped member 60. It defines within the member 60 and over substantially all the height of the beam 30 a closed lateral area 62 and a larger open rea 63. The back of the U-shaped member 60 is towards the glass 36 of the door (FIG. 6).

FIGS. 5 and 7 also show that the vertical carriage 31 is itself formed by a U-shaped member mounted in the area 63 of the beam 30. The length of the carriage 31 is relatively small compared with the height of the beam 30; its depth is also less than that of the beam and leaves a gap in the back of the beam, in the area 63. It carries on each of two sides two pairs of rollers 64 and 65 and the members 60 and 62 carry, at the sides of the area 63, two rails 66 and 67 for guiding the carriage 31 vertically over substantially all the height of the beam. A top end stop 68 and a bottom end stop 69 limit the travel of the carriage 31 on the beam.

Referring to FIGS. 5 and 7 or FIG. 6, it is seen that the carriage 31 has a lateral lug 70 extending in front of the closed area 62 of the beam. This lug 70 carries a plate 71 for attaching a chain 72 onto which is hooked a carriage counterweight 73 and cables and wires 74 which control the holding device 32 and its support 33.

From the plate 71 the chain 72 runs in front of the closed area 62 towards the upper part of the beam where it is fitted onto a toothed sprocket 75. The sprocket 75 redirects the chain into the area 62 in which the carriage counterweight 73 is disposed. The area 62 is open to the front at the level of the sprocket 75 which is coupled to the shaft of the motor 52 driving the vertical carriage 31. It transmits drive to the carriage 31 via the chain 72 which drives the counterweight 73 in the area 62 in the opposite direction to the carriage.

In a similar way the cables 74 run in front of the closed area 62 of the beam 30 from the plate 71 to the upper part of the beam where they are redirected inside the area 62 on passing over pulleys 77 mounted on the same shaft as the sprocket 75. In the upper part of the area 62 they pass over direction-chain pulleys 78 from which is suspended a cable tensioning weight 79. The pulleys 78 redirect them towards the end of the beam where they are anchored and where they are connected to the corresponding cables and form the cables contained in the previously mentioned trunking 55. When the carriage 31 moves the weight 79 for tensioning the cables 74 fixed to the plates 71 and to the upper part of the beam moves in the area 62 in the opposite direction to the carriage and over a distance which is half that over which the carriage moves.

The beam 30 and the vertical carriage 31 on the beam provided for rapid positioning of the holding device 32 in front of any of the various magazines identified relative to a system of X and Y axes.

The support 33 for the holding device carries the device 32 at one end and is articulated to the carriage 31 at the other end. It is described with reference to FIG. 5 and, more particularly, FIGS. 9 and 10 which show it schematically in association with its control devices.

The support 33 comprises two arms 80 and 81 defining a parallelogram linkage between the carriage 31 and the device 32. Each of these two arms has one end articulated by a pivot 80A and 81A to a parallelogram support member 83 fixed into the lower part of the carriage 3; the other end of each of the arms 80 and 81 is articulated by a pivot 80B or 81B to another parallelogram support member 82. This stirrup-shaped member 82 is itself articulated by a pivot 82A to the holding device 32.

The support 33 comprises a link 84 controlling the angular orientation of the holding device 32 at the end of the support 33. This link 84 is mounted between the two arms 80 and 81, substantially in contact with the arm 80. It has a first end coupled to the carriage 31 by a cam 85. A roller 84A on this first end of the link guides the link over the cam 85 which is defined by an arcuate aperture receiving the roller 84a formed in a part 86 attached to the carriage 31. The other end of the link 84 is in the shape of a bent and split beak which exits the arm 80 through a cut-out (unreferenced) in the arm 80 and which is articulated to the holding device 32 taken as a whole by a pivot 84B. This link is held and guided against the arm 80 by appropriate supports 84C disposed at substantially one-third and one-half the length of the link from its articulation 84b to the device 32.

A maneuvering lever or yoke 87 controls the link 84 from a control member consisting of a drive nut 88 movable heightwise of the carriage 31. This lever or yoke is articulated to the nut by a pivot pin 87A. At the other end a tie-rod 89 articulates it to the arm 81 of the support 33 by means of a pivot 87B on the arm 81.

The cam or aperture 85 is substantially umbrella handle-shaped. The part 85, the innermost part within the U-shaped profile of the carriage, is strongly curved while the larger other part 85B is substantially straight.

Figure 9:
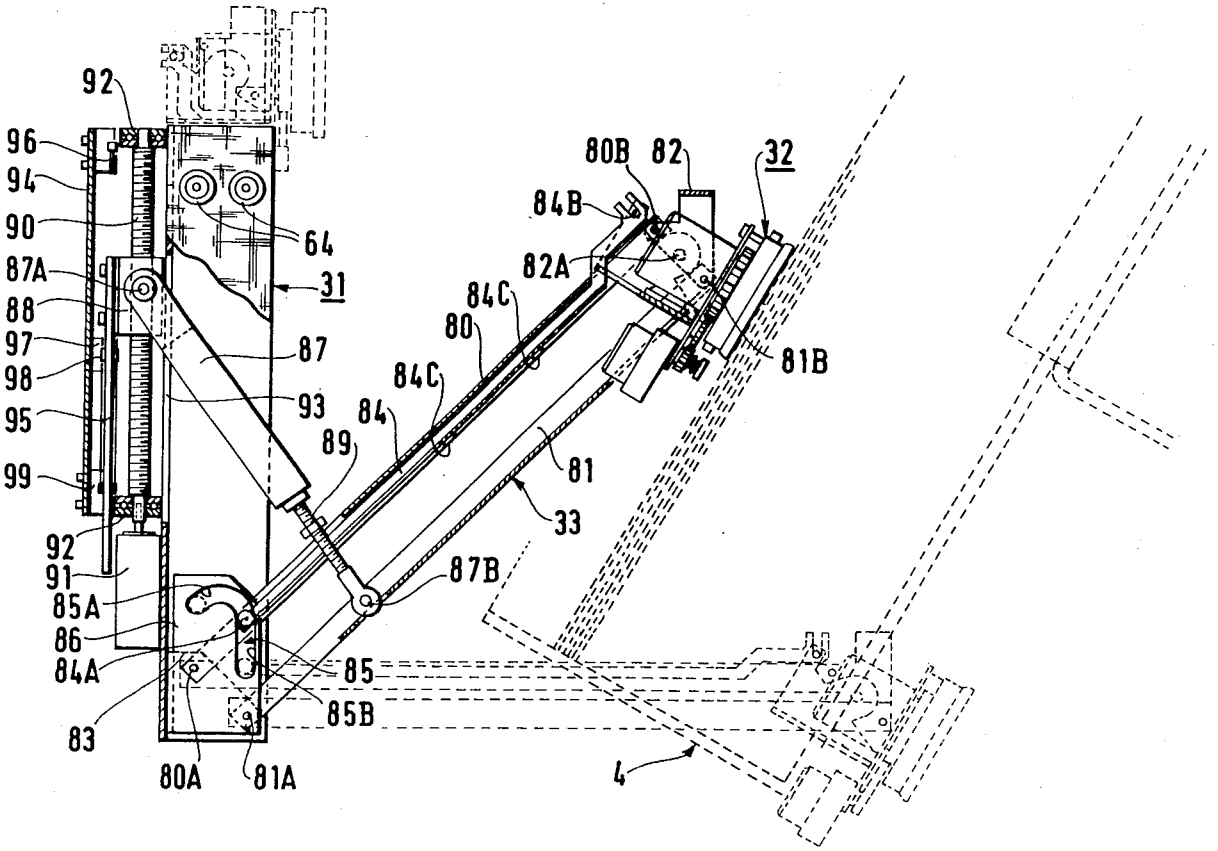
FIG. 9 is a view partially in cross-section of the combination of a vertical carriage and a holding device forming part of the extraction and dispensing mechanism.

FIG. 9 shows in dashed outline the support 32 carrying the device 32 in two possible extreme angular positions relative to the carriage, respectively a position retracted within the carriage, when it is vertical, and a so-called terminal holding position, when it is substantially horizontal; it shows in full outline the support 33 in an initial holding position, in one of the filled magazines 4, when it is at substantially 45°, also in dashed outline. These two extreme angular positions are obtained for two extreme positions of the nut 88 coupled to the support 33 by the lever or yoke 87.

For the various angular positions of the support 33, by virtue of the effect of the control lever 84 the holding device itself takes up a specific orientation relative to the support 33 defined by the two parts 85A and 85B of the cam 85. Between the vertical position with the support retracted into the carriage 31 and the initial holding position the roller 84A moves along the part 85A. In the vertical position with the support 33 retracted the device 32 projects slightly to the front of the carriage 31 in a vertical position. In the initial holding position shown in full outline it is inclined on the support 33, taking up an angular position at 60° C. to the horizontal so as to be parallel to the packets in the magazine 4. Between the intial holding and terminal holding positions in the magazine the roller 84A moves on the part 85B of the cam. This part 85B of the cam increases the inclination of the device on the support 33 as the support inclines relative to the carriage, so as to maintain at a constant 60° the inclination of the device to the horizontal over the full height of the stack of packets in the magazine 4.

FIG. 9 also shows that for the horizontal terminal holding position the holding device 32 lies below the magazine 4, after passing through the cut-out 27 in its bottom and towards the front. Should this happen the magazine 4 is empty. The terminal holding angular position of the support 33 thus provides a way of sensing that a magazine is empty.

Figure 10:
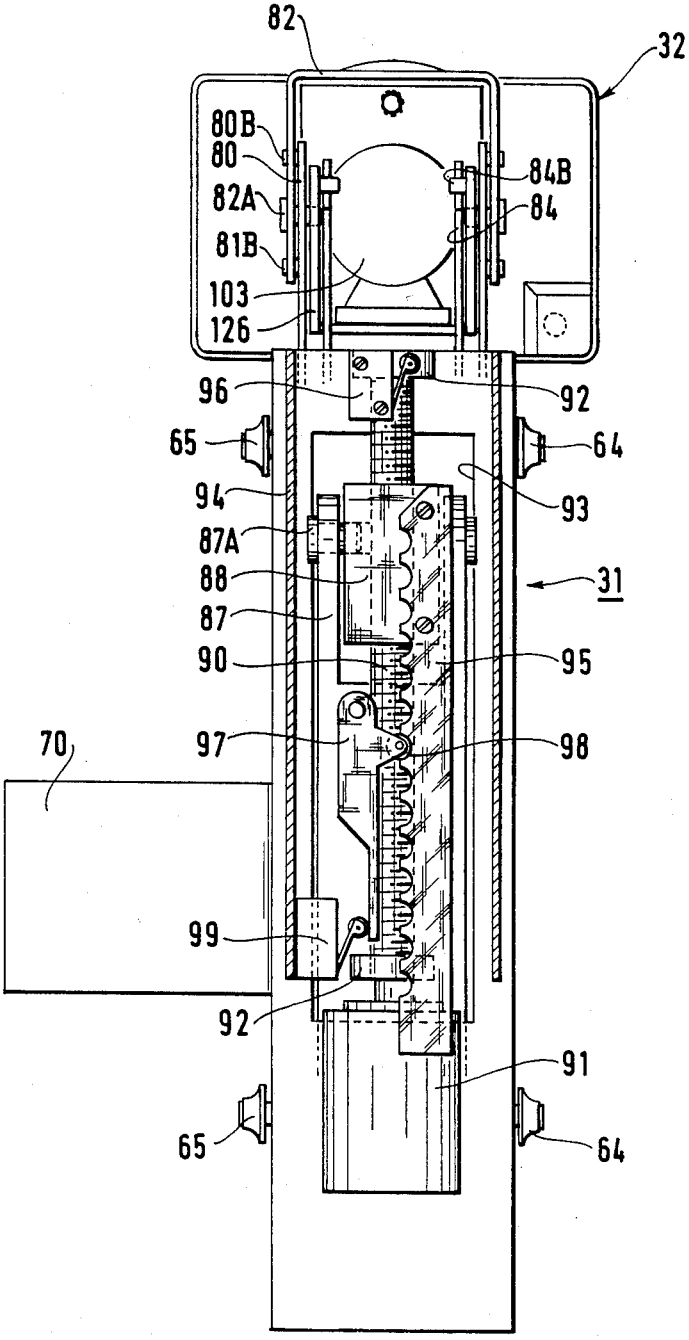
FIG. 10 is a rear view of the combination of the vertical carriage and the holding device from FIG. 9.

How the support 33 is controlled in its various possible angular positions is described with reference to FIG. 9 and more particularly with reference to FIG. 10.

This control is exercised by the nut 88 which moves in translation along the back of the carriage 31 over a defined travel.

The drive nut 88 is mounted on a screw 90 rotated by a motor 91. The screw 90 and its motor 91 are carried by the carriage 31, in the space at the back of the beam left free by the carriage. The screw 90 is mounted in bearing 92 fixed to the back of the carriage 1 at the top and bottom. Two apertures or a single wide aperture 93 in the back of the carriage allow the control lever or yoke 87 to pass through the U-shaped member of the carriage.

Rotation of the screw 90, which results in translation of the nut 88, moves the support 33 to the angular position required to place the holding device firmly in contact with the top packet to be taken from one of the magazines and to the retracted position in order to dispense the selected packet. Simultaneously, by virtue of the cam 85, it keeps the holding device in the required angular position, namely parallel to the packets for all possible holding positions, and then a position with the device retracted into the beam and the carriage, with only its terminal part vertical and projecting in front of the beam and the carriage.

A sensor responsive to the angular position of the support 33 is advantageously associated with the control mechanism comprising the nut 88. It is shown in FIG. 10.

The sensor responsive to the angular position of the support 33 comprises a rack 95 fixed to the nut 88 and moving with it and a switch 96 for sensing the position with the support 33 retracted into the carriage. The rack 95 is mounted on the rear surface of the nut, opposite the side facing towards the back of the carriage: the switch 96 is mounted on a support plate 94 fixed to the bearings 92 and corresponds to the high position of the nut on the screw so that it can be actuated directly by the rack. The sensor further comprises a sensing lever 97 with a tooth (in fact a small roller) 98 intermediate its ends and an associated switch 99 coupled elastically to one end of the lever 97. The lever 97 and the associated switch 99 are mounted on the support plate 94 and fixed relative to the carriage 31. The lever 97 is spring-loaded so that its tooth 98 is fully engaged in the teeth of the rack. Each time it passes over one of these teeth it rotates the lever to open the switch.

The number of times the switch 99 is opened gives the number of times the tooth 98 has been stepped along the rack and represents the angular position of the support 33 relative to its retracted position, also referred to as its zero angular position. The switch 99 makes it possible to sense in particular the horizontal terminal holding position in which the holding device has passed through the cut-out in the bottom of the magazine, towards the front. This indicates that the magazine concerned is empty.

The switches 96 and 99 are both connected to electrical connecting wires (not shown) which are fed through the carriage 31 to the lateral lug 70 carrying the fixing plate 71, where they are secured (FIGS. 5 and 7).

Figure 11:
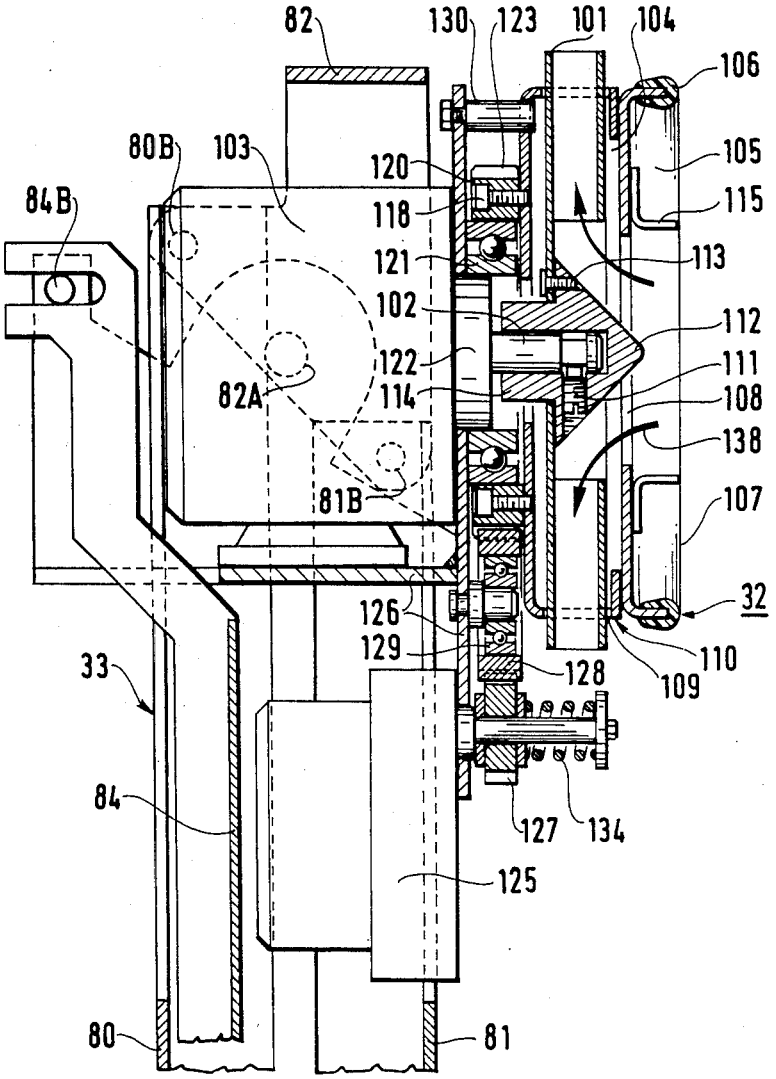
Figure 12:
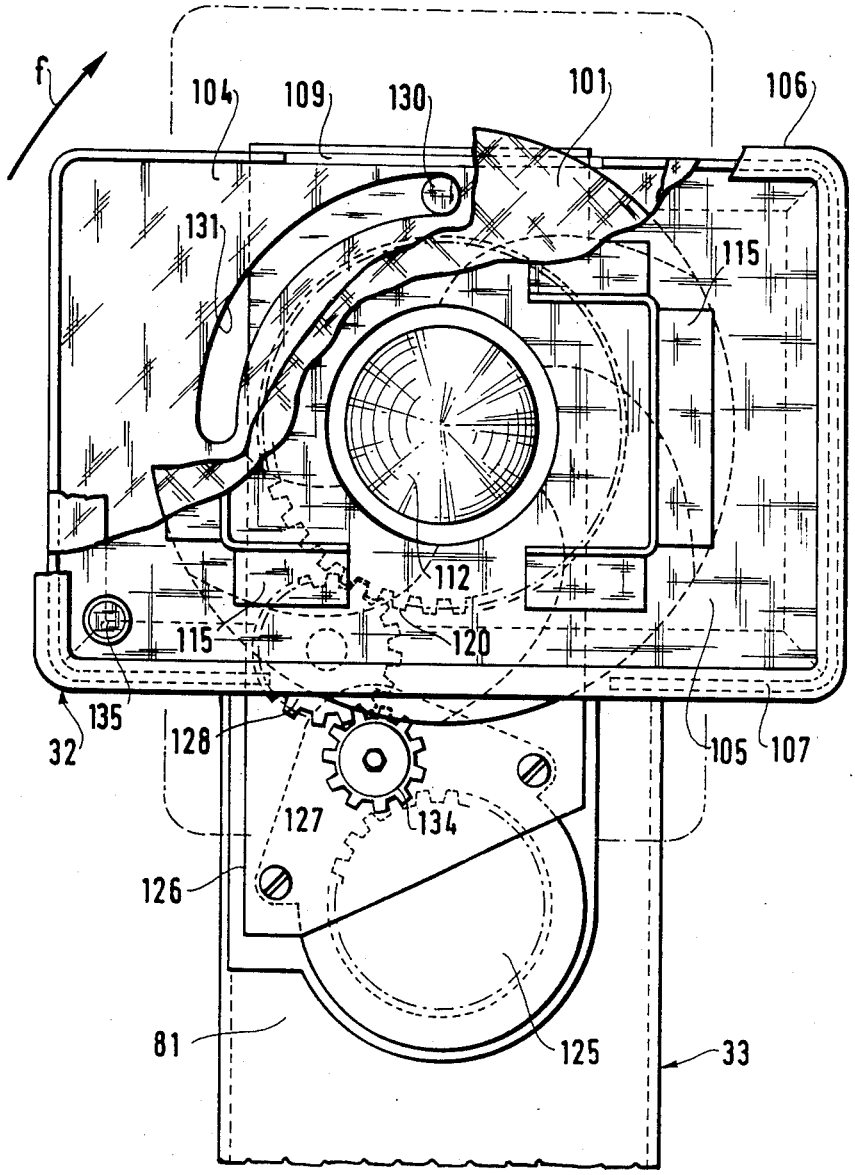
FIG. 12 is a front view of the holding device.
Figure 13:
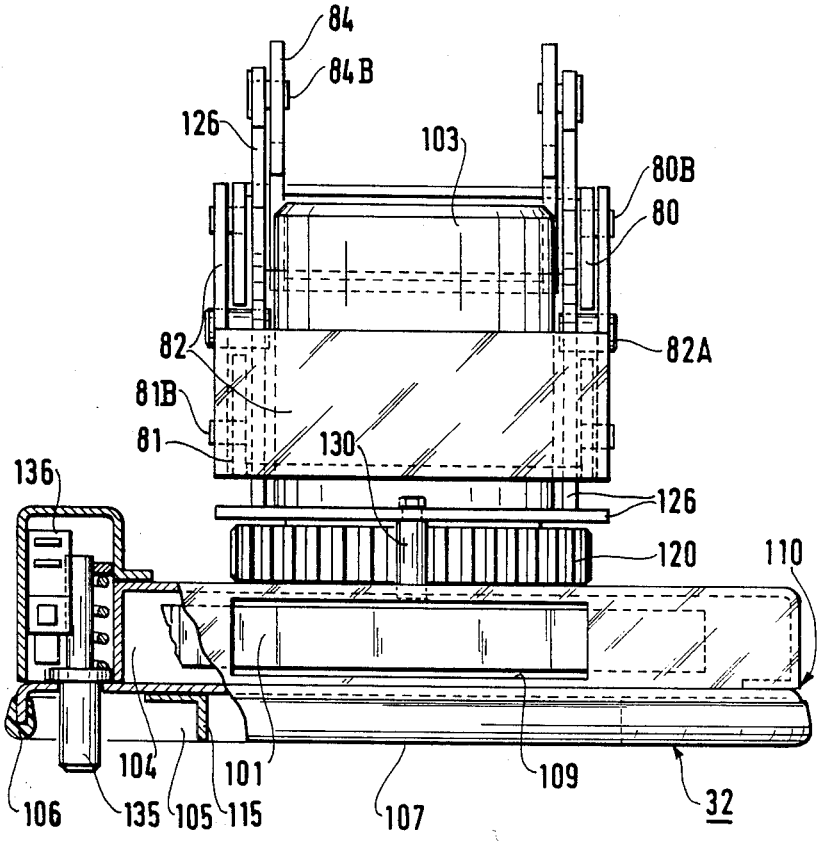
FIG. 13 is a plan view partially in cross-section of the front part of the holding device.

The holding device 32 coupled to the end of the support 33, that is to the link 84 and, by the connecting part 82, to the arms 80 and 81, as shown in FIG. 9, is described with particular reference to FIGS. 11 through 13.

The holding device comprises a turbine 101 fixed to the end of the shaft 102 of a drive or turbine motor 103. The turbine 101 is mounted in a first flat chamber 104 which communicates with a second flat chamber 105 referred to as the front chamber. The motor 103 and the front chamber 105 are on opposite sides of the chamber 104.

The two flat chambes 104 and 105 are of rectangular cross-section and have the same peripheral contour. The front chamber 105 has an open surface at the front with a sealing bead 106 around its peripheral edge and constitutes a holding surface 107. The opening 108 providing communication between the two chambers is on the axis of the turbine and on the axis of the motor. Lateral openings 109 are provided in the chamber 104, substantially in the central part of its larger dimension side walls, the turbine projecting slightly through these openings 109.

The two chambers 104 and 105 are in back-to-back relation to each other and fixed to each other, by spot welding, for example. They form on the shaft of the motor 103 a terminator assembly generally designated 110, carried by the motor but free to rotate relative to its shaft 102, and within which the turbine rotates with the shaft 102. This terminator assembly containing the turbine is partially partitioned forwardly of the turbine and open at the front and laterally to the turbine.

The turbine 101 is fixed to the end of the shaft 102 by a screw 111. A conical cap 112 mounted in the central part of the turbine and fixed to the turbine by screws 113, for example, covers the screwhead and forms an inlet cone where air enters the turbine. This cap also defines on the turbine, externally of the side facing the motor 103, a sleeve 114 for centering the turbine on the shaft 102.

Two U-shaped member 115 are mounted facing each other in the front chamber 105. They constitute two end stops for the packets taken up by the holding device. They are spot welded to the back of the front chamber 105 and ensure that packets are held flat against the terminator assembly of the holding device.

The terminator assembly 110 is fixed by screws 118 to a ring 120 mounted on a ball bearing 121 itself mounted on the bearing 122 of the motor 103. The ring 120 and the terminator assembly 110 are thus free to rotate relative to the shaft 102.

The ring 120 has teeth 123 around its perimeter and is coupled to a control motor-gearbox unit 125. This motor-gearbox unit 125 and the motor 103 are supported on a motor support member 126. A control gearwheel 127 on the shaft of the motor-bearbox unit and an intermediate ring 128 mounted on another ball bearing 129 carried by the member 126 coupled the motor-gearbox unit and the ring 120 for rotation of the terminator assembly 110 about the axis of the turbine 101 independently of rotation of the latter by the turbine motor 103.

A peg 130 and an arcuate slot 131, one fixed and independent of the terminator assembly and the other moving with the terminator assembly, guide rotation of the terminator assembly 110 and limit this rotation to 90°. In the embodiment shown the slot 131 is formed on the outside of the back of the chamber 104 and the peg is carried by a branch of the motor support member 126. In connection with such limitation of rotation of the terminator assembly to 90°, a torque limiter 134 is associated with the control gearwheel 127 on the shaft of the motor-gearwheel unit 125.

The holding device 32 is further provided with a circuit for sensing application of the device against the packet to be held. It comprises a feeler in the form of a retractable finger 135 mounted at one side of the terminator assembly 110 and, in its non-retracted position, projecting through the holding surface 107, together with an associated switch 136 mounted in corresponding relationship to the finger on the terminator assembly. This switch is operated by the finger 135 when the latter retracts as a result of firm application of the holding device 32 onto the packet to be held.

The holding device 32 is mounted at the end of the support 33 by means of the aforementioned parallelogram support member 82 which is stirrup-shaped and is articulated at 82A to the motor support member 126.

On the holding device, the power supply cables of the motors 103 and 125 and the control connection wires from the switch 136 are secured onto the motor support member 126 and onto the support 33 for the device. They are routed into the carriage 31 and secured onto the cable fixing plate carried by this carriage.

In operation the device 32 is brought into contact with the top packet in a stack and which it is to hold by appropriate displacement of its support 33. In this way it is applied firmly against this packet, which closes off its holding surface 107. The feeler 135 is then retracted and its switch transmits this information to stop the motor 91 (FIG. 10) to confer the required angular position on the support 33 and to start the turbine motor 103. Rotation of the turbine causes suction in the chamber 104 and depressurizes the front chamber 105, closed off at this time by the packet, by causing air to circulate from the front chamber 105 to the lateral openings 109 in the chamber 104 via the turbine, as shown by the arrows 138 in FIG. 11. The packet is held against the holding surface by suction and continues to close off this surface.

The turbine continuing to be rotated by its motor 103, the packet is taken from its magazine by delayed commanding of the motor 91 (FIG. 10) to return the support 33 to the vertical position in which it is retracted into the carriage 31 with the holding device holding the packet in front of the beam in a vertical plane.

Depending on the type of packet held, the terminator assembly of the holding device may be rotated through 90° to rotate the packet through 90° in its vertical plane. In the case of large packets in particular, this improves presentation of the packet to the outlet slot to which it is fed by the carriage and the beam.

FIGS. 14A, 14B, 15, 16, 17A and 17B represent in a schematic way the mechanism associated with the packet outlet slot 6 provided in the side of the cabinet 1 (FIG. 1) during various phases of its operation. It comprises a flap 140 normally closing off the slot 6 and an associated set of flat links (unreferenced) with close and open the flap. This mechanism is controlled directly by the previously mentioned extraction and dispensing mechanism 5, represented in these figures in a highly simplified way by the contour of the lower part of the beam 30 on he front of which is shown the terminator assembly 110 of the holding device 32, projecting from the beam towards the interior of the cabinet. The packet 141 selected by the extraction and dispensing mechanism 5, which is held by the holding device 32, will be transferred towards the slot 6 and finally dispensed and released from the holding device during the phases shown.

The linkage includes a flat link 145 coupled to the flap and two control levers 146 and 147 at the bottom of the cabinet, to the front of the flap and slightly below the path of movement of the beam 30; the lever 146 controls opening of the flap 140 and the level 147 controls closing thereof.

The link 145 is coupled to the flap 140 which has at its lower end a horizontal flap lug 150 with a right-angle bend in it and the end of which is articulated to one end of the link by a pivot 151. This flat lug is articulated to the bottom of the cabinet by a pivot 152 which defines the vertical axis on which the flap pivots.

The lever 146 controlling opening of the flap has substantially in its center a pivot 154 articulating it to the bottom of the cabinet. One of its ends is articulated to the link 145 by a pivot 155; its other end is connected to a return spring 156 anchored to the bottom of the cabinet to hold the flap 140 closed. The articulation 155 to the link is below the path of movement of the branch 157 of the beam 30 nearer the slot 6. A roller 158 projecting above the link and the lever is mounted on the pivot 155; it forms an obstacle just in front of the path of movement of the end of the branch 157 of the beam, which is fitted to this end with a projecting but retractable finger 159 disposed to contact the roller. The finger 159 is mounted on the outside of the branch 157 by fixing lugs 160 defining between then and on the finger a finger pivot axis 161.

The lever 147 controlling closing of the flap is mounted in relation to the lever 146. It has a notch 163 in an intermediate part of one edge with which a peg 164 carried by the lever 146 cooperates.

The lever 147 carries a roller 165 projecting from one end towards the end of the second branch 167 of the beam. The branch 167 is truncated so that is shorter than the branch 157 and is equipped at the end, on its inside, with a finger 168 for hooling onto the roller 165. The lever 147 has a pivot 169 between the notch 163 and its other end and a return spring 166 is coupled to this other end and anchored to the bottom of the cabinet to hold the lever 147 against the peg 164 on the lever 146.

At the outlet slot 6 from the cabinet lateral guides 170 and 171 form a substantially V-shaped configuration inside the cabinet, enclosing an angle of 90° and with the point cut off and centered on the slot 6. The flap 140 is open by retracting it behind the guide 171 towards the rear of the cabinet. The other, or front guide 170 is associated with plates 172 for supporting the delivered packet and forming support points facing the flap on the corresponding edge of the slot 6. These plates 172 are shown only in FIGS. 16 and 17A which, compared with FIGS. 14A and 15, correspond to views taken at different levels.

Figure 14A:
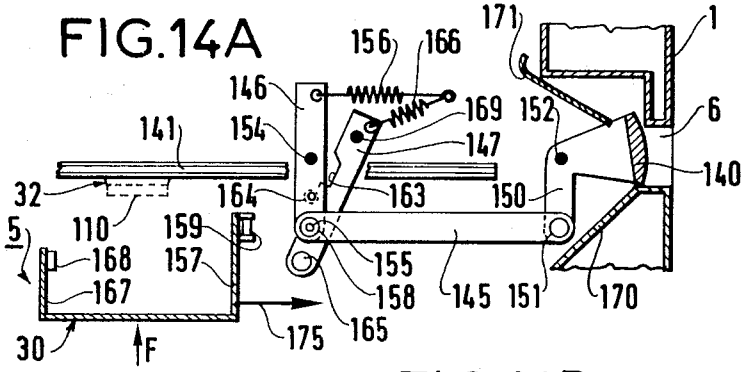
FIG. 14A is a plan view of a mechanism associated with the packet outlet slot of the dispenser from FIG. 1 controlled by the extraction and dispensing mechanism.
Figure 14B:
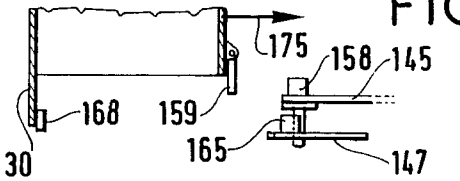
FIG. 14B is a partial view in the direction of the arrow F in FIG. 14A.

FIGS. 14A and 14B show the flap 140 in its normal, closed position, the packet 141 that has been selected and is held by the holding device 32 ready for delivery and the beam which is being driven towards the slot 6 in the direction of the arrow 175. The finger 159 on the beam is about to come into contact with the roller 158. The lever 147 lies against the peg 164 but the latter is outside the notch. Under these conditions the flap 140 is drawn into the closed position and shuts off the slot 6, in which there is no packet.

Figure 15:
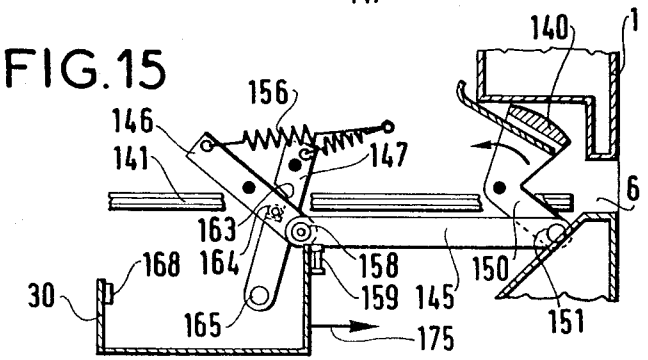

FIG. 15 shows that the action of the finger 159 on the roller 158 has retracted the roller by rotating the lever 146 on its pivot 154 against the action of the spring 156. As the roller 158 is retracted, the link 145 is pushed towards the slot; because it is articulated to the lug 150, it causes the flap 140 to pivot and so opens the slot 6. At the same time as this happens, the peg 164 on the lever 146 enters the notch on th elever 147, acted on by its own spring 166, to lock these levers. Locking the levers prevents the lever 146 resuming its initial position (FIG. 14A) after the roller 158 is retracted in front of the finger 159. Thus the flap remains open and the packet is inserted into the slot 6.

Figure 16:
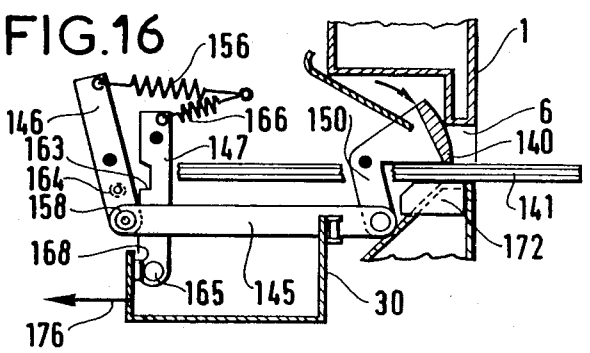
FIGS. 15, 16 and 17A are three views corresponding to FIG. 12A for different stages in functioning of the mechanism associated with the outlet slot.

FIG. 16 shows the action of the finger 168 on the roller 165 of the lever 147 when the packet 141, still held by the holding device 32 and inserted into the slot 6, has become readily accessible from outside the cabinet. The thrust of this finger on the roller has caused the lever 147 to pivot against the action of its spring; this has resulted in the levers being unlocked. The lever 147 continues to be acted on by the finger 168; the lever 146, released from the lever 147 and acted on by its spring 156, displaces the link 145 and returns the flap 140 towards its closed position. The flap 140 comes up against the packet 141 which is therefore held in the slot 6 between the plates 172 and the flap which is being urged towards its closed position.

Figure 17A:
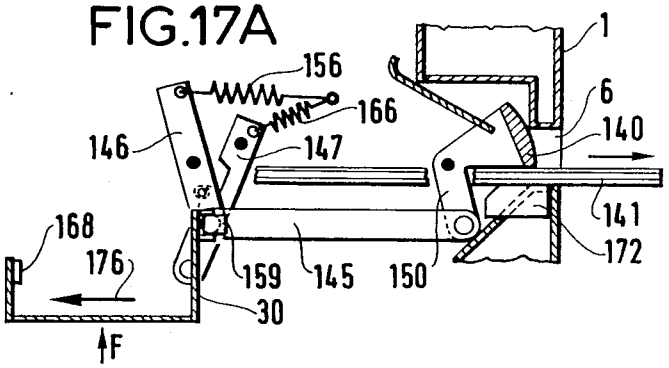
Figure 17B:
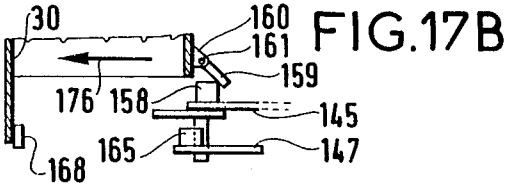

In FIGS. 17A and 17B the packet has been released by the holding device and is held in the slot ready to be taken out, while the beam is moving away from the slot 6 as shown by the arrow 176. During this return movement of the beam the finger 159 comes into contact with the roller 158. Since for movement in this direction the branch 157 does not represent an obstacle to its pivotting, it is retracted in front of the roller 158 and exterts no action on the lever 146. The flap 140 continues to be urged towards the closed position. As soon as the packet 141 is grasped and taken from the slot 6 the flap 140 will close it completely.

Although this has not been shown, with a view to representing the mechanism associated with the flap 140 as clearly as possible, the plates 172 are in practise spaced from each other by an amount depending on the height of the slot 6, to enable the holding device 32 to be inserted between them. This corresponds to driving the beam 30 virtually to the edge of the door, on the side where the slot is, with the control levers 146 and 147 remaining unlocked, and makes it possible to insert even the smallest packets into the slot 6 before they are released by the holding device 32.

Figure 18:
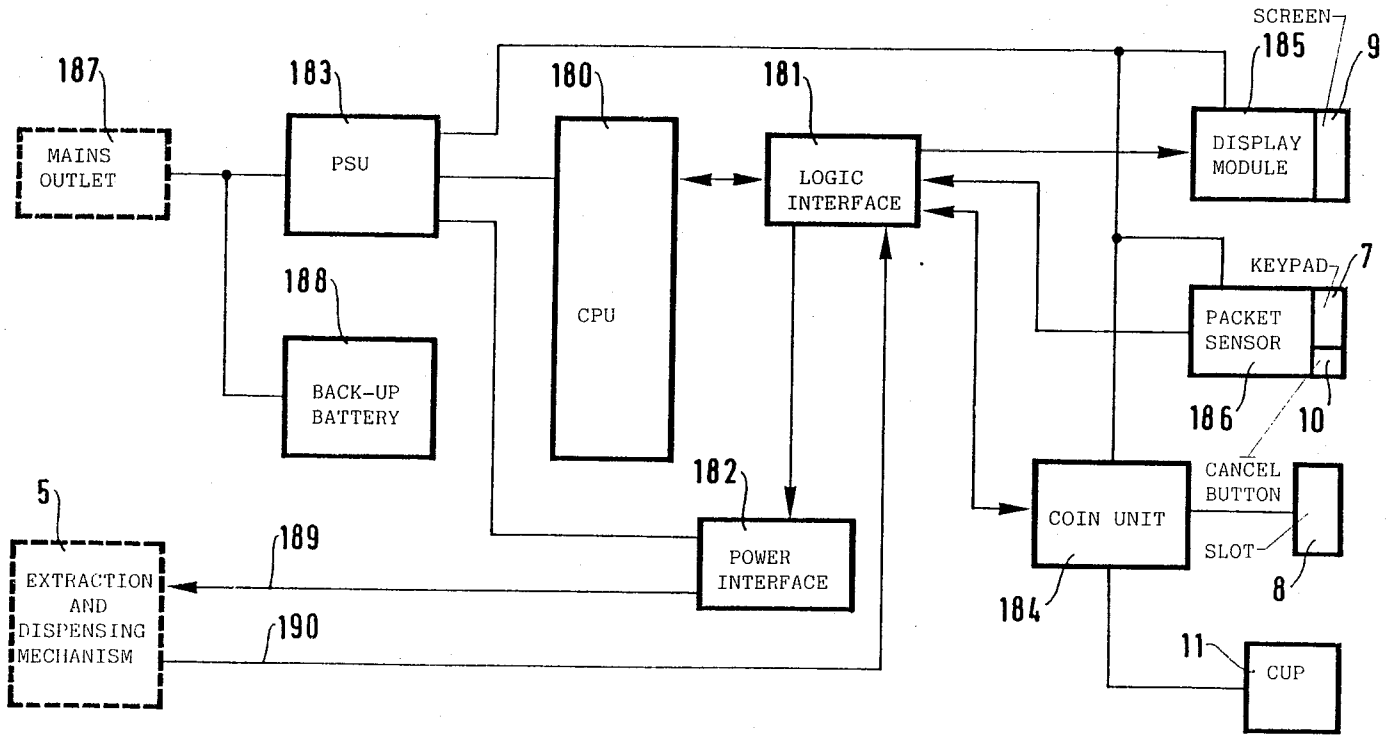
FIG. 18 is block diagram of the control circuit for the dispenser.

FIG. 18 is a block diagram of the control circuit of the dispenser, contained in the box unit 3 external to the cabinet 1 (FIG. 1).

The control circuit essentially comprises a programmed central processor unit (CPU) 180, a logic interface circuit 181, a power interface circuit 182 and an electrical power supply unit (PSU) 183. It further comprises a coin unit 184 connected to the coin slot 8 and the cup 11 mounted on the front of the box unit, a display module 185 the screen 9 of which is mounted on the front of the box unit and a selected packet sensing circuit 186 connected to the keypad 7 and to the cancel key 10 mounted on the front of the box unit.

The power supply unit 183 is connected to a mains power outlet schematically represented by the dashed outline block 187. It is also connected to a back-up battery 188 inside the box unit associated with a mains fail sensor (not shown). It derives from the mains voltage or from the back-up battery and distributes over multiple output connections the various voltages at various power levels necessary for operation of the control circuit itself and for operation of the extraction and dispensing mechanism contained in the cabinet, the back-up battery being used only to complete a dispensing operation already initiated or to enable a request for a packet that has already been made to be cancelled and the coins returned. The power interface circuit 182 controlled by the logic interface circuit 181 supplies power to the various motors of the extraction and dispensing mechanism 5 in the cabinet, schematically shown in dashed outline, at the appropriate times and over cables 189.

The logic interface circuit 181 connects to the central processor unit 180 of the display module 185, the sensor circuit 186, the coin unit 184 and the various sensing circuits mounted on the extraction and dispensing mechanism 5 connected to it via links 190.

The central processor unit 180 is programmed and its essential functions comprise:

- controlling the extraction and dispensing mechanism is the cabinet, according to the specific arrangement of the magazines,
- administering and accounting for payments and dispensing of packets, and
- controlling dialogue messages displayed on the screen of the display module according to an operating menu.

The commands associated with these functions will now be described with reference to a packet dispensing operation, assuming that the dispenser is initially inoperative and displaying a message indicating the first step of the procedure for selecting a packet by pressing the appropriate keys.

The user makes his choice and a new message is displayed indicating the product or products selected and their price. Payment having been entered and confirmed, the requested packet is dispensed or the requested packets are dispenses one after the other, the extraction and dispensing mechanism performing the following actions for the packet selected or each packet in turn:

- it positions the holding device in front of the appropriate magazine,
- it places the holding device on the top packet in this magazine,
- it grips the packet by suction, it extracts the packet from the magazine and holds it in a vertical position practically in contact with the beam, if necessary, it rotates the packet through 90° in the vertical plane, such rotation being conditioned by the type of packet, it places the holding device in line with the outlet slot, it inserts the packet into the slot, and it switches off the suction.

A message is displayed to indicate that the packet is accessible in the slot and, where appropriate, how many packets remain to be dispensed.

If the selection made by the user is invalid for some reason, because the requested type of packet is not available, for example, messages are displayed briefly to justify why that selection cannot be made.

If the payment is not confirmed, becasue the cancel key 10 is pressed, for example, then the payment is cancelled (the coins are returned). The dispenser reverts to the inoperative condition.

At regular intervals, or for a predetermined number of packets dispensed, the central processor unit 180 returns the beam and the vertical carriage to reference positions relative to which the locations of the various magazines are defined and in relation to which the corresponding commands for movement of the beam and the carriage are defined. These reference positions are defined, for example, by the end stops 39 on the beam 30 (FIG. 5) and the top or bottom end stop 68 or 69 for the carriage 31 on the beam (FIG. 5).

The present invention has been described by way of example with reference to one embodiment shown in the drawings. It is to be understood that modifications of detail may be made to this and/or parts thereof replaced by equivalent parts without departing from the scope of the invention.

There is claimed:

1. Dispenser for flat products, comprising a cabinet and in said cabinet magazines for storing a plurality of products stacked according to predefined categories, an outlet for a product selected from one of said magazines, and a mechanism for extracting and dispensing said products disposed in front of said magazines and adapted to extract the top product from a selected stack and transfer it to said outlet, wherein said mechanism comprises a product holding device, individually controlled and motorized vertical and horizontal carriages carrying said device and a support for said device articulated to one of said carriages and adapted to assume a holding position in which said device is placed against said top product in a selected stack and a position retracted against said carriages, said dispenser further comprising a control circuit responsive to a signal selecting one of said products, and wherein said magazines are inclined to the horizontal so that said stacks are offered up slantwise to said mechanism and said outlet is in a side of said cabinet, between said magazines and said mechanism.

2. Dispenser according to claim 1, wherein said horizontal carriage comprises a vertical beam extending over substantially the full height of said cabinet and mobile substantially widthwise and said vertical carriage is carried by said beam, is mobile substantially lengthwise of said beam and carries said support with said holding device.

3. Dispenser according to claim 2, wherein said vertical beam is mounted on a wall of said cabinet forming a door in front of said magazines.

4. Dispenser according to claim 2, further comprising a box unit mounted on the outside of one side of said cabinet containing said control circuit and comprising on its opposite a keypad for selecting products, means of accepting payment for selected products and a display module all connected to said control circuit which is also connected to said extraction and dispensing mechanism.

5. Dispenser according to claim 2, further comprising cables and electrical connection wires fixed to said vertical carriage and connecting said support and said holding device to said control circuit, a weight for tensioning said cables and electrical connection wires, a drive chain for said vertical carriage and a carriage counterweight attached to said vertical carriage by said chain, and wherein said beam has a U-shaped profile with the open side facing towards said magazines and with said vertical carriage mounted within it and has a closed lateral area defining a housing for said tensioning weight and said counterweight.

6. Dispenser according to claim 2, further comprising a control link, a first pivot by which said control link is articulated to said carriage, a second pivot whereby said control link is articulated to said holding device, a maneuvering lever adapted to actuate said control link, a first end of said maneuvering lever articulated to said support, a control member movable in translation over substantially the full height of said carriage, a second end of said maneuvering lever articulated to said control member and a parallelogram linkage defined by said support between said holding device and said carriage and associated with said control link.

7. Dispenser according to claim 6, further comprising a cam fixed to said carriage and of substantially umbrella handle shape having an arcuate first part adapted to command progressive retraction of said holding device against said support as said support moves towards said position retracted against said carriage and a substantially linear second part adapted to procure a constant angular position of said holding device appropriate to the inclination of said magazines for any possible angular position necessary to pick up a product in a magazine, said first pivot articulating said link to said carriage being guided by said cam.

8. Dispenser according to claim 7, further comprising a motor mounted on said carriage and adapted to be controlled by said control circuit, a screw driven by said motor, a nut mounted on said screw and constituting said control member and a sensor associated with said control member responsive to the angular position of said support.

9. Dispenser according to claim 7, wherein said sensor responsive to the angular position of said support comprises a rack and an associated articulated sensing lever of which one is fixed and the other moves with said carriage, and a switch coupled to said lever and/or to said rack and connected to said control circuit.

10. Dispenser according to claim 9, wherein said carriage has a U-shape profile and said angular position sensor is mounted on the back of said profile so as to lie between said carriage and the back of said beam.

11. Dispenser according to claim 9, wherein said angular position sensor comprises two switches adapted to sense two limiting angular positions of said support corresponding to said position retracted against said carriages and a predefined terminal holding position in any magazine.

12. Dispenser according to claim 7, wherein said holding device comprises a motor having an output shaft, a terminator assembly mounted on and freely rotatable on said shaft and a turbine rotatable within said terminator assembly, wherein said terminator assembly is partly partitioned forwardly of said turbine and comprises a flat suction chamber open laterally and adapted to contain said turbine and a flat holding chamber forward of and communicating with said suction chamber having an open holding surface facing forwardly and adapted to be closed off by an object to be held.

13. Dispenser according to claim 12, wherein said holding chamber comprises a sealing bead at the peripheral edge of said holding surface.

14. Dispenser according to claim 13, further comprising a centered toothed wheel freely rotatable on said shaft and to which said terminator assembly is fixed and a motor-gearbox unit controlling the orientation of said terminator assembly relative to said shaft and to which said toothed wheel is coupled.

15. Dispenser according to claim 14, further comprising a peg and a slot in which said peg is inserted, one of said peg or said slot being on said terminator assembly and mobile therewith and the other of said peg or slot being fixed relative to said holding device, said peg and said slot constituting guide means and travel limiting means for said terminator assembly, and further comprising a torque limiter associated with said motor-gearbox unit.

16. Dispenser according to claim 7, further comprising a feeler in the form of a retractable projecting finger at the terminal end of said holding device and a switch controlled by said feeler which senses placing of the holding device against a product in a magazine, said switch being adapted to command termination of translation movement of said control member of said maneuvering lever of said support.

17. Dispenser according to claim 16, wherein said magazines comprise inclined shelves fixed to the rear of said cabinet and two vertical partitions with upstanding edges for each magazine attached to one of said shelves and projecting towards the front of said cabinet and defining between them, forwardly of said shelf, a cutout in the bottom of the magazine concerned through which said holding device can pass.

18. Dispenser according to claim 2, further comprising a mechanism for closing off said outlet in said cabinet, said closing mechanism comprising an articulated flap, a flat link coupled to said flap, a first lever actuating said flat link to open said flap and a second lever actuating said first link to close said flap, said first and second levers being actuated in succession by said beam when a selected product is placed before said outlet and when said product is partially inserted into said outlet, respectively.

19. Dispenser according to claim 18, further comprising means for locking together said levers for opening and closing said flap and wherein said levers for opening and closing said flap are adapted to urge said flap towards a closed position except when said product is partially inserted in said outlet.

20. Dispenser according to claim 4, wherein said control circuit comprises a programmed central processor unit, a power interface circuit adapted to be connected by cables to said extraction and dispensing mechanism and a logic interface circuit connected between said central processor unit and said power interface circuit and said devices mounted on said box unit.

21. Dispenser according to claim 20, wherein said central processor unit is adapted to command positioning of at least said beam against a positional reference end stop.

* * * * *